US008810353B2

(12) United States Patent
Oshima et al.

(10) Patent No.: US 8,810,353 B2
(45) Date of Patent: Aug. 19, 2014

(54) REACTOR AND METHOD FOR MANUFACTURING SAME

(75) Inventors: Yasuo Oshima, Tokyo (JP); Susumu Handa, Tokyo (JP); Kota Akaiwa, Tokyo (JP); Taichi Tamura, Tokyo (JP)

(73) Assignee: Tamura Corporation, Tokyo (JP)

( * ) Notice: Subject to any disclaimer, the term of this patent is extended or adjusted under 35 U.S.C. 154(b) by 29 days.

(21) Appl. No.: 13/519,101

(22) PCT Filed: Dec. 20, 2010

(86) PCT No.: PCT/JP2010/007369

§ 371 (c)(1),
(2), (4) Date: Sep. 7, 2012

(87) PCT Pub. No.: WO2011/077694

PCT Pub. Date: Jun. 30, 2011

(65) Prior Publication Data

US 2012/0326830 A1 Dec. 27, 2012

(30) Foreign Application Priority Data

Dec. 25, 2009 (JP) ..... 2009-296417

(51) Int. Cl.

| | |
|---|---|
| ***H01F 27/24*** | (2006.01) |
| ***H01F 17/04*** | (2006.01) |
| ***H01F 1/03*** | (2006.01) |
| ***C22C 1/05*** | (2006.01) |
| ***H01F 41/02*** | (2006.01) |
| ***H01F 27/255*** | (2006.01) |
| ***H01F 1/26*** | (2006.01) |
| ***H01F 37/00*** | (2006.01) |
| *C22C 33/02* | (2006.01) |
| *H01F 1/24* | (2006.01) |

(52) U.S. Cl.

CPC .. *H01F 1/26* (2013.01); *C22C 1/05* (2013.01); *C22C 33/02* (2013.01); *H01F 41/0246* (2013.01); *H01F 27/255* (2013.01); *C22C 2202/02* (2013.01); *H01F 1/24* (2013.01); *H01F 37/00* (2013.01)

USPC ..... 336/233; 336/221; 148/104

(58) Field of Classification Search

CPC ..... H01F 1/24; H01F 1/33; H01F 3/08; H01F 1/1475; B22F 1/02; B22F 1/0059

USPC ..... 336/219, 233, 83, 205, 221; 428/833, 428/833.1, 836.3, 842.4, 842.6; 148/104, 148/300, 513

See application file for complete search history.

(56) References Cited

U.S. PATENT DOCUMENTS 5,651,841 A * 7/1997 Moro et al. ..... 148/309
6,284,060 B1 9/2001 Matsutani et al.

(Continued)

FOREIGN PATENT DOCUMENTS

EP 0 872 856 10/1998
JP 2002-033211 1/2002

(Continued)

*Primary Examiner* — Alexander Talpalatski
*Assistant Examiner* — Joselito Baisa

(57) ABSTRACT

In a first mixing process, soft magnetic powders and inorganic insulative powders of 0.4-1.5 wt % relative to the soft magnetic powders are mixed. In the heating process, a mixture through the first mixing process is heated at a temperature of 1000° C. or more and below the sintering temperature of the soft magnetic powders under a non-oxidizing atmosphere. In the granulating process, a silane coupling agent of 0.1-0.5 wt % is added to form an adhesiveness enhancing layer. A silicon resin of 0.5-2.0 wt % is added to the soft magnetic alloy powders having the adhesiveness enhancing layer formed by the silane coupling agent to form a binding layer. A lubricating resin is mixed, and a mixture is pressed and molded to form a mold. In an annealing process, the mold is annealed under a non-oxidizing atmosphere to form a dust core which is used to form a reactor.

12 Claims, 7 Drawing Sheets

(56) References Cited

U.S. PATENT DOCUMENTS

| | | | | |
|---|---|---|---|---|
| 7,510,790 | B2 * | 3/2009 | Kishimoto et al. | 428/842.9 |
| 8,048,191 | B2 * | 11/2011 | Lu et al. | 75/255 |
| 8,328,955 | B2 * | 12/2012 | Wakabayashi et al. | 148/104 |
| 8,366,837 | B2 * | 2/2013 | Wakabayashi et al. | 148/306 |
| 2004/0126609 | A1 * | 7/2004 | Ueta et al. | 428/570 |
| 2005/0257854 | A1 | 11/2005 | Maeda et al. | |
| 2008/0231409 | A1 | 9/2008 | Kugai et al. | |
| 2011/0025444 | A1 | 2/2011 | Sugiyama et al. | |

FOREIGN PATENT DOCUMENTS

| | | |
|---|---|---|
| JP | 2003-217919 | 7/2003 |
| JP | 2003-32116 | 11/2003 |
| JP | 2004-095935 | 3/2004 |
| JP | 2005-217289 | 8/2005 |
| JP | 2005-336513 | 12/2005 |
| JP | 2006-344867 | 12/2006 |
| JP | 2006-344868 | 12/2006 |
| JP | 2007-012866 | 1/2007 |
| JP | 2007-214366 | 8/2007 |
| JP | 2008-112935 | 5/2008 |
| JP | 2009-224584 | 10/2009 |
| JP | 2009-302165 | 12/2009 |
| JP | 2010-245459 | 10/2010 |
| JP | 2010-251474 | 11/2010 |

* cited by examiner

- BACKGROUND ART -

REACTOR AND METHOD FOR MANUFACTURING SAME

TECHNICAL FIELD

The present invention relates to a reactor and a method for manufacturing the same which uses a reactor core formed of a dust core and which have windings around the outer circumference of the reactor core.

BACKGROUND ART

Control power sources for an OA equipment, a solar power generator system, an automobile, and an uninterruptable power supply, etc., use a choke coil as an electronic device, and such a choke coil uses a ferrite magnetic core or a dust core. The ferrite magnetic core has a disadvantage that the saturated magnetic flux density is small. Conversely, the dust core formed by molding metallic powders has a higher saturated magnetic flux density than that of soft magnetic ferrite, and has a good DC superposition characteristic.

The dust core is demanded to have a magnetic characteristic capable of obtaining a large magnetic flux density by a small applied magnetic field and a magnetic characteristic of a small energy loss inherent to a change in the magnetic flux density because of the demands for improvement of the energy exchange efficiency and reduction of the generated heat. The energy loss includes a core loss (iron loss) caused when the dust core is used in an AC magnetic field. The core loss (Pc) can be expressed as a sum of a hysteresis loss (Ph) and an eddy current loss (Pe) as is indicated in the following Equation (1). The hysteresis loss is proportional to an operating frequency as is indicated in the following Equation (2), and the eddy current loss (Pe) is proportional to the square of the operating frequency. Hence, the hysteresis loss (Ph) is dominating at a low-frequency range, while the eddy current loss (Pe) is dominant at a high-frequency range. The dust core needs a magnetic characteristic that reduces the occurrence of such a core loss (Pc).

$$Pc=Ph+Pe \tag{1}$$

$$Ph=Kh\times f\ Pe=Ke\times f^2 \tag{2}$$

where Kh is a hysteresis loss coefficient, Ke is an eddy current loss coefficient, and f is a frequency.

In order to reduce the hysteresis loss (Ph) of the dust core, it is necessary to facilitate the mobility of a magnetic domain wall, and in order to do so, it is appropriate to reduce the magnetic coercive force of the soft magnetic powder particles. By reducing the magnetic coercive force, both improvement of the initial permeability and reduction of the hysteresis loss can be achieved. The eddy current loss is inverse proportional to the specific resistance of the core as is indicated in the following Equation (3).

$$Ke=k1Bm^2t^2/\rho \tag{3}$$

where k1 is a coefficient, Bm is a magnetic flux density, t is a particle size (thickness of a plate material), and ρ is a specific resistance.

Such a dust core is used for a switching power supply, etc., for electronic devices, and is used as a core of a reactor that eliminates AC components (noises) superimposed on a DC output. In order to accomplish the eliminating effect of noises, the dust core used as the core of a reactor needs to have a high saturated magnetic flux density. Moreover, since main currents of a power supply device flow through the reactor, if the loss of the dust core is large, a large amount of heats is generated. In order to prevent such heat generation, it is necessary for the dust core used as the core of the reactor to have a low core loss.

Hence, as shown in FIG. 13, in order to increase the current value for saturating the magnetic core, prevent a saturation of the magnetic flux density even if a large current flows, and ensure the function as the magnetic core of the reactor, a technique is known which forms a plurality of gaps orthogonal to the magnetic path of the dust core that is the core of a reactor, and disposes an insulative (non-magnetic) material formed of, for example, a resin in such gaps (see, for example, Patent Literatures 1 to 3).

According to the technologies disclosed in Patent Literatures 1 to 3, however, the leakage flux near the gap causes the winding and the core to generate heat, and when such technologies are applied to a reactor, the circuit efficiency decreases. Moreover, the leakage flux becomes a noise source to a peripheral device, and induces an eddy current loss to a peripheral conductor. Furthermore, from the standpoint of the structure, an assembling process of the core becomes complex, resulting in the cost increase, and a gap and a magnetic material collide with each other and move apart from each other at each gap, resulting in a cause of undesired sound at the time of actuation.

Hence, in order to address or reduce various technical issues due to a gap when such a gap is provided in the magnetic core of a reactor, a reactor is known which uses, as the magnetic core of the reactor, a nanocrystal material that is a low permeability material and which eliminates a gap (see, for example, Patent Literatures 4 and 5).

Patent Literature 1: JP 2004-095935 A
Patent Literature 2: JP 2007-012866 A
Patent Literature 3: JP 2009-224584 A
Patent Literature 4: JP 2006-344867 A
Patent Literature 5: JP 2006-344868 A According to the dust core formed of the nanocrystal material used in Patent Literatures 4 and 5, however, the powder itself is rigid, molding is difficult and the density of the dust core becomes low (equal to or less than 85% of a theoretical density). Hence, the permeability of the dust core formed of the nanocrystal material can be low, but the permeability/DC superposition characteristic becomes poor. Moreover, the maximum magnetic flux density of the material itself is small, even if it is used as a reactor, an L value (an inductance) largely decreases at a high magnetic field.

The present invention has been made to address the above-explained problems, and it is an object of the present invention to provide a reactor and a method for manufacturing the same which use, as a magnetic core of the reactor, a dust core formed by a high-pressure molding while uniformly dispersing insulative fine powders around a soft magnetic powder to maintain a high density, and the dust core with a low permeability to improve the DC superposition characteristic of the magnetic core of the reactor, thereby eliminating a gap and downsizing of the reactor.

SUMMARY OF THE INVENTION

To achieve the object, the present invention provides a reactor that includes: a dust core; and a winding wound around the dust core, the dust core is formed by: mixing soft magnetic powders and nonorganic insulative powders of 0.4 wt % to 1.5 wt % relative to the soft magnetic powders; mixing and granulating a mixture of the soft magnetic powders and the nonorganic insulative powders with a binder insulative resin, and further mixing a lubricating resin; and pressing and molding a mixture to form a shaped body, and annealing the shaped body, and the dust core that is a core of the reactor is provided with no gap orthogonal to a magnetic path of the dust core.

Moreover, a reactor and a method for manufacturing the same using the following dust core are also included in the scope and spirit of the present invention.

(1) Produced by a heating process at a temperature of equal to or higher than 1000° C. and below a sintering temperature that causes soft magnetic powders to start sintering after the soft magnetic powders and nonorganic insulative powders are mixed.

(2) Produced by making the nonorganic insulative powders dispersed uniformly on the surface of the soft magnetic powder, setting the average particle size of the nonorganic insulative powders to be 7 to 500 nm in order to ensure the insulative property, and using the soft magnetic powders containing 0.0 to 6.5 wt % of silicon components.

(3) Produced by using the soft magnetic alloy powders containing 0 to 6.5 wt % of silicon components.

According to the reactor of the present invention, by using the dust core with a good DC superposition characteristic, the following advantages can be obtained.

(1) Since the core of the reactor has no gap, heat generation by the winding and the core due to the leakage flux near a gap can be suppressed, thereby preventing the reduction of the circuit efficiency.

(2) Noises in the peripheral devices due to the leakage flux near a gap can be reduced, and the eddy current loss of a peripheral conductor can be reduced.

(3) Since the core is provided with no gap, the assembling of the core is facilitated and is inexpensive.

(4) Undesired sound is prevented which may be generated when a gap and a magnetic material collide with each other and move apart from each other near the gap at the time of actuation if a gap is provided. Moreover, the present invention improves the DC superposition characteristic of the dust core, thereby enabling downsizing of the reactor.

EMBODIMENTS OF THE INVENTION

[1. Manufacturing Process of Dust Core]

Figure 1:
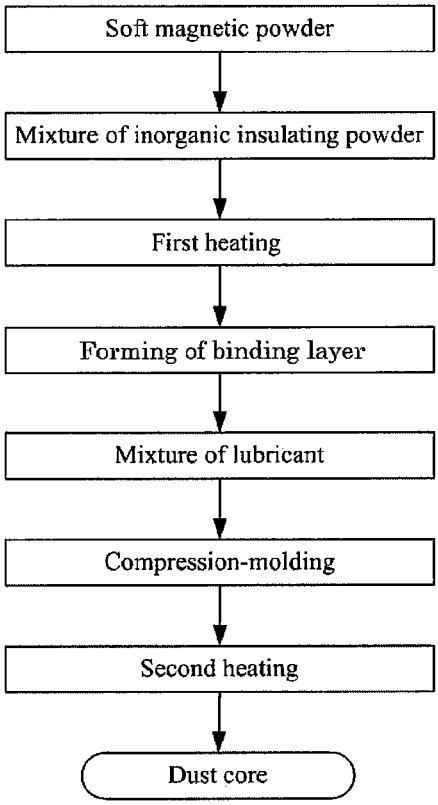
FIG. 1 is a flowchart showing a method for manufacturing a dust core according to an embodiment.

A method for manufacturing a dust core that will be a reactor core according to the present invention includes following processes as shown in FIG. 1.

(1) A first mixing process in which soft magnetic powders is mixed with inorganic insulating powders (Step 1).

(2) A heating process in which a mixture obtained in the first mixing process is heated (Step 2).

(3) A granulating process in which a binder insulative resin is mixed with the soft magnetic powders and the nonorganic insulative powders having undergone the heating process (Step 3).

(4) A second mixing process in which the soft magnetic powder and the inorganic insulating powder granulated by the binder insulative resin is mixed with a lubricant resin (Step 4).

(5) A molding process in which the mixture having undergone the second mixing process is compression-molded so as to form a mold body (Step 5).

(6) An annealing process in which the mold body obtained in the molding process is annealed (Step 6).

Each process will be explained below in detail.

(1) First Mixing Process

In the first mixing process, soft magnetic powders mainly containing iron are mixed with inorganic insulative powders.

[Soft Magnetic Powders]

The soft magnetic powders used are produced through a gas atomizing technique, a water-gas atomizing technique or a water atomizing technique, have an average particle size of 5 to 30 μm, and contain 0.0 to 6.5 wt % of silicon components. When the average particle size is larger than the range from 5 to 30 μm, an eddy current loss (Pe) increases. Conversely, when the average particle size is smaller than the range from 5 to 30 μm, a hysteresis loss (Ph) increases due to the reduction of a density. It is appropriate if equal to or less than 6.5 wt % of silicon components are contained in the soft magnetic powders relative to the soft magnetic powders, and if it is larger than this value, the shaping ability becomes poor, the density of the dust core decreases, resulting in the decrease of the magnetic characteristic.

When soft magnetic alloy powders are prepared through a water atomizing technique, the soft magnetic powders become amorphous, and the surface of the powder becomes uneven. Hence, it is difficult to uniformly distribute the inorganic insulative powders on the surface of the soft magnetic powder. Moreover, upon molding, stress is concentrated on the projecting portion of the surface of the powder, and a dielectric breakdown is likely to occur. Hence, when mixing the soft magnetic powders and the inorganic insulative powders, a device that exerts a mechanochemical effect on the powders, such as a V-type mixer, a W-type mixer, and a pot mill, is used. In addition, a mixer that gives a mechanical energy like compressive force or shearing force to the powders is also used, and both mixing and surface modification can be simultaneously performed.

Furthermore, a surface smoothing treatment is performed on the mixed powders obtained by mixing the soft magnetic powders with the inorganic insulating powders, so as to uniformly cover the surface of the magnetic powder by inorganic insulating powder and make the rough surface even. The DC superposition characteristic depends on the aspect ratio of the powders, and it is appropriate if the aspect ratio is set to be 1.0 to 1.5 through this treatment. This treatment is executed by plastically deforming the surface in mechanical manner. Examples of such a treatment are mechanical alloying, ball milling, and attritor.

[Inorganic Insulative Powders]

The inorganic insulative powders to be mixed have an average particle size of 7 to 500 nm. When the average particle size is less than 7 nm, the granulation becomes difficult, and when it exceeds 500 nm, uniform dispersion on the surface of the soft magnetic powder becomes difficult, and thus the insulation performance cannot be ensured. Moreover, it is preferable that the additive amount of the inorganic insulating powder should be 0.4 to 1.5 wt %. When the additive amount is less than 0.4 wt %, the sufficient performance cannot be accomplished and when it exceeds 1.5 wt %, the density remarkably decreases, and thus the magnetic characteristic decreases. It is preferable that at least one of following kinds should be used as such an inorganic insulative material: MgO (melting point: 2800 degrees); $Al_2O_3$ (melting point: 2046 degrees); $TiO_2$ (melting point: 1640 degrees); and CaO powders (melting point: 2572 degrees) all of which have a melting point over 1500° C.

When the heating process to be discussed later is omitted, insulative powders, such as talc and calcium carbonate, can be used regardless of the temperature of the melting point.

(2) Heating Process

In the heating process, in order to reduce the hysteresis loss and to heighten the annealing temperature after molding, heating is performed on the mixture obtained through the first mixing process under a non-oxidizing atmosphere having a temperature of equal to or higher than 1000° C. as well below the sintering temperature at which the soft magnetic powders start sintering. The non-oxidizing atmosphere may be a reductive atmosphere like a hydrogen atmosphere, an inactive atmosphere, or a vacuumed atmosphere. That is, it is preferable that such an atmosphere should not be an oxidizing atmosphere.

At this time, the inorganic insulative powders, which were dispersed uniformly on the surface of the soft magnetic alloy powder through the first mixing process, form an insulative layer which accomplishes the above-explained object and which prevents the soft magnetic powders from fusion bonding with each other at the time of the heating process. Moreover, by executing the heating process at a temperature of equal to or higher than 1000° C., a strain present in the soft magnetic powder is eliminated, a defect of a crystal grain boundary, etc., is eliminated, and the growth (expansion) of a crystal grain in the soft magnetic powder is promoted, thereby facilitating the displacement of a magnetic domain wall, decreasing the magnetic coercive force, and reducing the hysteresis loss. In contrast, if the heating process is executed at the sintering temperature of the soft magnetic powders, the soft magnetic powders are sintered and bonded to each other, and thus such powders cannot be used as the material for the dust core. Hence, it is necessary to execute the heating process at a temperature below the sintering temperature.

The heating process can be omitted depending on the kind of the inorganic insulative powders to be used. In this case, in the mixing of the first mixing process, the flattening process is executed for making dispersion to the surface of the soft magnetic powder uniform and the rough surface of the powder even. Hence, the inorganic insulative powder having the lower hardness is preferable, since the strain upon the molding can be eased, thereby reducing the hysteresis loss.

(3) Granulating Process

In the granulating process, in order to make the inorganic insulative powder uniformly dispersed and to enhance the adhesiveness, insulative films of a double-layer structure are formed. As a first layer, an adhesiveness enhancing layer is formed by a silane coupling agent on the surface of the soft magnetic alloy powder. The silane coupling agent is added in order to enhance the adhesiveness between the inorganic insulative powder and the soft magnetic powder, and it is most suitable if the additive amount is 0.1 to 0.5 wt %. When the additive amount is smaller than such values, the adhesive effect is insufficient, and if it is greater than such values, the molding density decreases, resulting in the deterioration of the magnetic characteristic after annealing. As a second layer, a binding layer is formed by a silicon resin on the surface of the soft magnetic alloy powder where the adhesiveness enhancing layer is formed by the silane coupling agent. The silicon resin is added to enhance the binding performance, and to prevent a formation of vertical streaks in a core wall surface due to a contact of the mold with the powders at the time of molding. It is most suitable if the additive amount is 0.5 to 2.0 wt %. If the additive amount is smaller than such values, the insulative performance decreases, and vertical streaks are formed in the core wall surface at the time of molding. If the additive amount is larger than such values, the shaping density decreases, and the magnetic characteristic after annealing is deteriorated.

(4) Second Mixing Process

In the second mixing process, in order to reduce the releasing pressure of an upper punch at the time of molding, and to prevent the formation of vertical streaks in the core wall surface due to a contact of the mold with the powders, the mixture having undergone the granulating process is mixed with a lubricating resin. Example lubricating resins used and mixed are waxes, such as stearic acid, salt of stearic acid, soap of stearic acid, and ethylene-bis-stear-aramid. By adding those, the slipping of the granulated powders against each other becomes fine, and thus the density at the time of mixing increases, thereby increasing the molding density. Moreover, it becomes possible to prevent the powders from seizing to the mold due to heat. The amount of the lubricating resin to be mixed is set to 0.2 to 0.8 wt % relative to the soft magnetic powders. If the amount is smaller than such values, a sufficient effect cannot be obtained, the vertical streaks are formed in the core wall surface at the time of shaping, the releasing pressure becomes high, and thus releasing of the upper punch becomes difficult in the worst case. If the amount is larger than such values, the molding density decreases, and the magnetic characteristic after annealing is deteriorated.

(5) Molding Process

In the molding process, the soft magnetic powders bound by the binder as explained above are injected into the metal mold, and molded by single-shaft molding using a floating die method. At this time, the binder insulative resin pressurized and dried serves as a binder at the time of molding. The pressure at the time of molding can be the same pressure as those of the conventional techniques, and according to the present invention, 1500 MPa or so is preferable.

(6) Annealing Process

In the annealing process, a mold body obtained by the molding is annealed under a non-oxidizing atmosphere like $N_2$ gas or $N_2$+$H_2$ gas at a temperature over 600° C. to form the dust core. If the annealing temperature is risen too high, the insulative performance is deteriorated, the magnetic characteristic is also deteriorated, and, in particular, the eddy current loss greatly increases. Accordingly, the core loss increases, and the above-explained non-oxidizing atmosphere is to suppress such an increase of the core loss.

At this time, the binder insulative resin is thermally decomposed when reaching a certain temperature during the annealing. When the heating process to the dust core is performed under the nitrogen atmosphere, the binder insulative resin adheres to the surfaces of the soft magnetic powders. Hence, even if the heating process is executed at a high temperature, no insulative characteristic deteriorates, and the hysteresis loss due to oxidization, etc., does not increase. Moreover, such a binder insulative resin also provides a role of increasing the mechanical strength.

[2. Measurement Items]

As the measurement items, a magnetic permeability, a maximum magnetic flux density and a DC superposition characteristics were measured through the following techniques. The magnetic permeability was calculated from an inductance at 20 kHz and 0.5 V by providing a primary winding (20 turns) around the produced dust core and using an impedance analyzer (Agilent Technologies, Co., Ltd.: 4294A).

Regarding the core loss, a primary winding (20 turns) and a secondary winding (3 turns) were provided around the dust core, and using a B-H analyzer (IWATSU Test Instrument Corporation: SY-8232) that was a magnetism measurement apparatus, the iron loss (core loss) was measured under a condition of a frequency of 10 kHz and a maximum magnetic flux density Bm of 0.1 T. This calculation was carried out by calculating a hysteresis loss coefficient and an eddy current loss coefficient through a least square technique using the frequency of the core loss based on the following Equation (4).

$$Pc=Kh\times f+Ke\times f^2$$

$$Ph=Kh\times f$$

$$Pe=Ke\times f^2 \quad \text{[Equation (4)]}$$

where:

Pc is a core loss;

Kh is a hysteresis loss coefficient;

Ke is an eddy current loss coefficient;

f is a frequency;

Ph is a hysteresis loss; and

Pe is an eddy current loss.

Moreover, the DC superposition characteristic was measured using an LCR meter to the produced reactor.

EXAMPLES

Examples 1 to 24 of the present invention will be explained below with reference to tables 1 to 5.

[3-1. First Characteristic Comparison (Comparison on Heating Temperature in Heating Process)]

In a first characteristic comparison, comparison was made with respect to the surface modification of the soft magnetic powder depending on the heating temperature in the heating process. In table 1, as the examples 1 to 3 and a comparative example 1, a temperature applied to the powders in the heating process was compared. Table 1 shows a temperature applied to the soft magnetic powders and an evaluation for the soft magnetic powders through an X-ray diffraction technique (hereinafter, referred to as an XRD).

According to the examples 1 to 3 and the comparative example 1, as the inorganic insulative powders, 0.4 wt % of $Al_2O_3$ having an average particle size of 13 nm (specific surface: 100 $m^2/g$) was added to Fe—Si alloy powders which were produced through a gas atomizing technique, had an average particle size of 22 μm and contained 3.0 wt % of silicon components. Next, a heating process of leaving samples of the examples 1 to 3 as those were under a reductive atmosphere of 25-% hydrogen (the remaining 75% was nitrogen) at a temperature of 950° C. to 1150° C. was performed for two hours.

Figure 2:
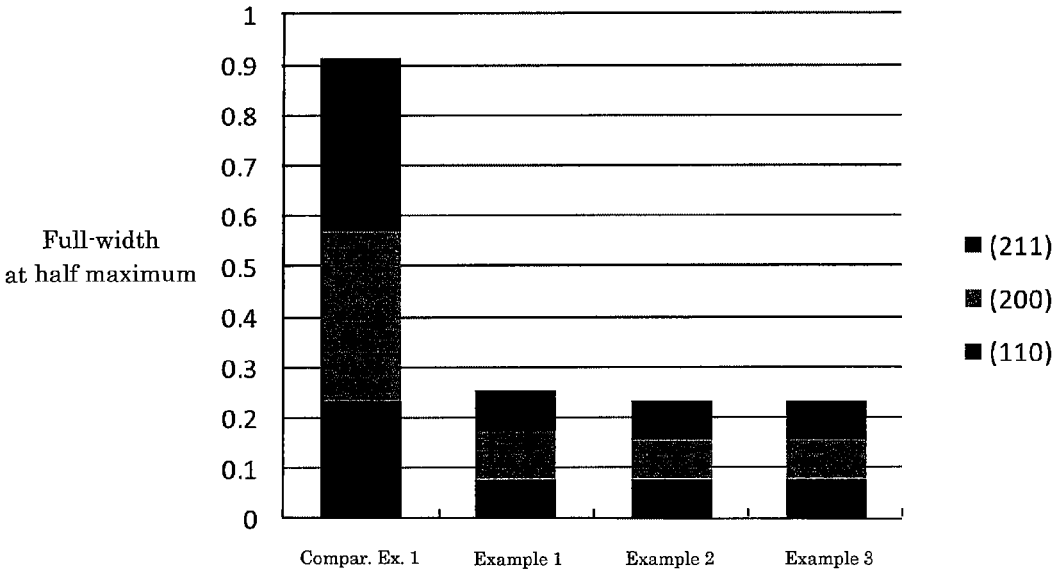
FIG. 2 is a diagram showing a sum of full-widths at half maximum of respective surfaces of (110), (200), and (211) in a first characteristic comparison.

Table 1 shows an evaluation of the full-width at half maximum made to the peaks of respective surfaces (110), (200), and (211) through the XRD for the examples 1 to 3 and the comparative example 1. FIG. 2 shows a sum of full-width at half maximum of respective surfaces of (110), (200), and (211) for the examples 1 to 3 and the comparative example 1.

TABLE 1

| | First heating | Full-width at half maximum | | |
|---|---|---|---|---|
| | Temperature (° C.) | (110) | (200) | (211) |
| Comparative Example 1 | — | 0.2349 | 0.334 | 0.345 |
| Example 1 | 1050 | 0.0796 | 0.094 | 0.080 |
| Example 2 | 1100 | 0.0773 | 0.077 | 0.080 |
| Example 3 | 1150 | 0.0783 | 0.076 | 0.081 |

As is clear from table 1 and FIG. 2, according to the comparative example 1 having undergone no heating in the heating process, each value of the full-width at half maximum of XRD peaks in the surfaces (110), (200), and (211) becomes large. The larger the strain of the powder is, the larger the full-width at half maximum becomes, and the smaller the strain of the powder is, the smaller the full-width at half maximum becomes, and thus according to the comparative example 1, the powders had a large strain. Conversely, according to the examples 1 to 3 having undergone heating in the first heating process, in comparison with the comparative example 1, each value of the full-width at half maximum of the XRD peaks in the surfaces (110), (200), and (211) is small. That is, by applying heating in the heating process, the strains of the powders were eliminated. Moreover, it is not illustrated in the table but the same effect can be accomplished when the heating process is performed at a temperature of equal to or higher than 1000° C.

That is, it becomes clear that the surfaces of the soft magnetic powders can be modified by performing the heating process on the soft magnetic powders at a temperature of equal to or higher than 1000° C. Accordingly, the surface roughness of the soft magnetic powders can be eliminated, the magnetic fluxes are concentrated at portions where a gap between the magnetic powders is small, and thus the magnetic flux density near the contact increases, thereby preventing an increase of the hysteresis loss. Moreover, by making the gap between the magnetic powders uniform, the gap provided between the magnetic powders becomes a dispersed gap, and thus the DC superposition characteristic can be improved. Conversely, when the heating process is performed at the sintering temperature that causes the soft magnetic powders to start sintering, the soft magnetic powders are sintered and solidified, and cannot be used as the material for the dust core. Hence, it is necessary to perform the heating process at a temperature below the sintering temperature of the soft magnetic powders.

As explained above, the temperature of the heating in the heating process for the dust core used for a reactor is set to be a temperature equal to or higher than 1000° C. and below a temperature that causes the soft magnetic powders to start sintering. Accordingly, the soft magnetic powders are not sintered and solidified at the time of the heating process, and a reactor and a method for manufacturing the same can be provided which use a dust core that can effectively reduce the hysteresis loss.

[3-2. Second Characteristic Comparison (Comparison for Additive Amount of Inorganic Insulative Material)]

In a second characteristic comparison, the additive amount of the inorganic insulative material to be added to Fe—Si alloy powders containing silicon components of 3.0 wt % was subjected to a comparison. Table 2 shows the kind and constituent of the inorganic insulative material added to the soft magnetic powders as comparative examples 2 to 6 and examples 4 to 14. Regarding the average particle size of each inorganic insulative material, $Al_2O_3$ was 13 nm (specific surface: 100 $m^2/g$) and 60 nm (specific surface: 25 $m^2/g$), and MgO was 230 nm (specific surface: 160 $m^2/g$).

Regarding samples used in this characteristic comparison, with respect to the Fe—Si alloy powders which were produced through a gas atomizing technique, had an average particle size of 22 μm, and contained 3.0 wt % of silicon components, the following inorganic insulative powders were added to prepare the samples.

In the comparative example 2 in a field A, no inorganic insulative powders were added.

In the comparative examples 3 and 4 in a field B, as the inorganic insulative powders, $Al_2O_3$ of 13 nm (specific surface: 100 $m^2/g$) was added by 0.20 to 0.25 wt %.

Moreover, in the examples 4 to 10, as the inorganic insulative powders, $Al_2O_3$ of 13 nm (specific surface: 100 $m^2/g$) was added by 0.40 to 1.50 wt %.

In the comparative example 5 and the examples 11 to 13 in a field C, as the inorganic insulative powders, $Al_2O_3$ of 60 nm (specific surface: 25 $m^2/g$) was added by 0.25 to 1.00 wt %.

In the comparative example 6 and the example 14 in a field D, as the inorganic insulative powders, MgO of 230 nm (specific surface: 160 $m^2/g$) was added by 0.20 to 0.70 wt %.

Thereafter, a heating process of leaving those samples as those were under a reductive atmosphere of 25-% hydrogen (the remaining 75% was nitrogen) at a temperature of 1100° C. was performed for two hours. Next, a silane coupling agent of 0.25 wt % and a silicon resin of 1.2 wt % were successively mixed, the mixture was heated and let dried (180° C. and 2 hours), and zinc stearate of 0.4 wt % as a lubricating agent was added and mixed.

Those samples were pressed and shaped at a pressure of 1500 MPa and at a room temperature, and ring-shaped dust cores having an outer diameter of 16 mm, an inner diameter of 8 mm, and a height of 5 mm were produced. Those dust cores were subjected to an annealing process for 30 minutes at a temperature of 625° C. under a nitrogen atmosphere ($N_2$+$H_2$).

Figure 3:
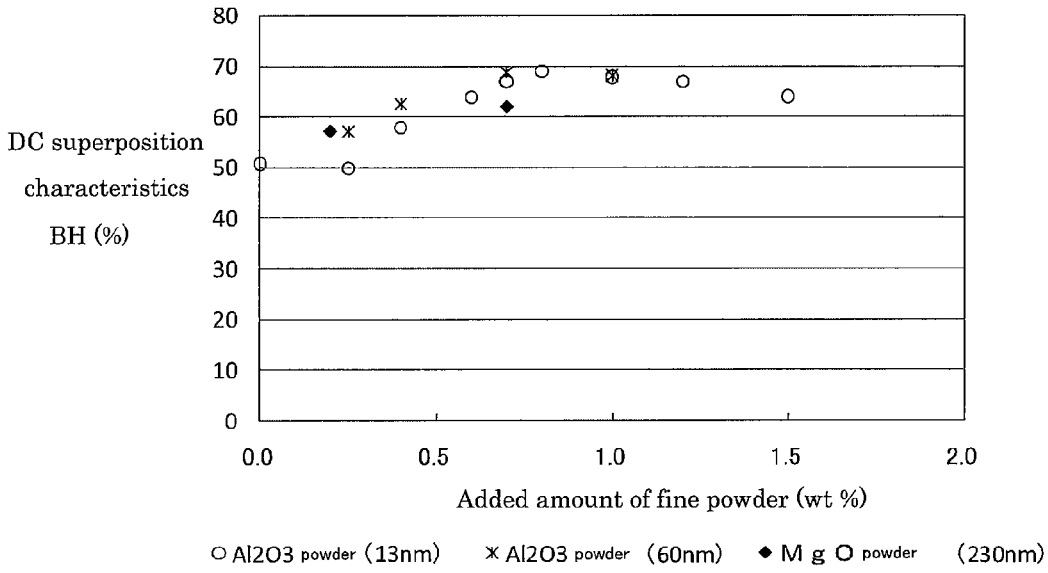
FIG. 3 is a diagram showing a relationship between the additive amount of fine powders and a DC superposition characteristic in a second characteristic comparison.
Figure 4:
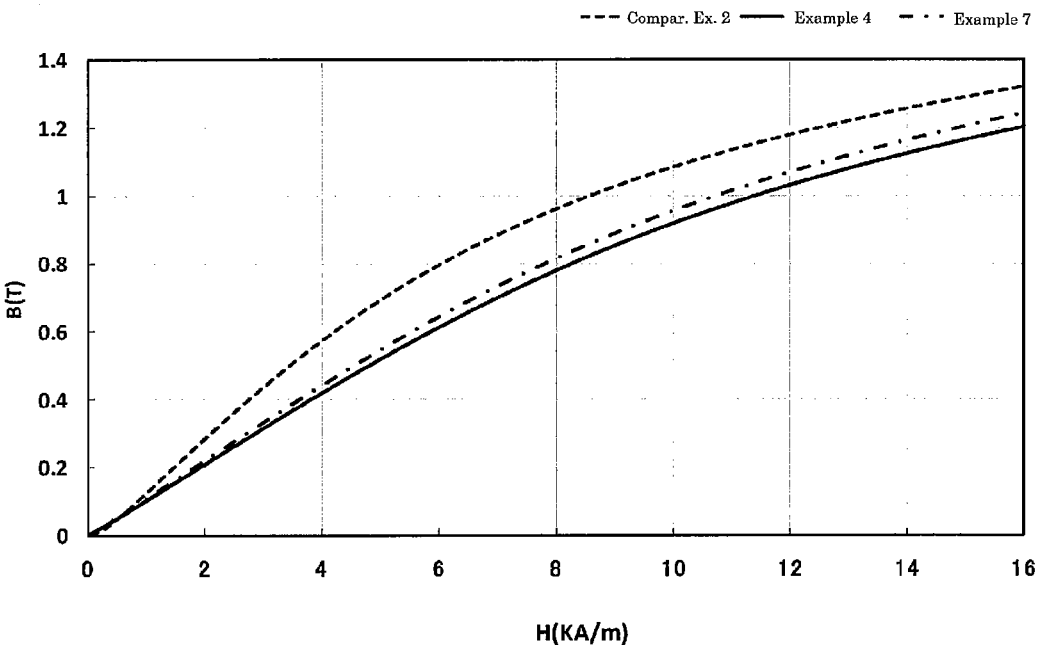
FIG. 4 is a diagram showing a DC B-H characteristic of a dust core in the second characteristic comparison.
Figure 5:
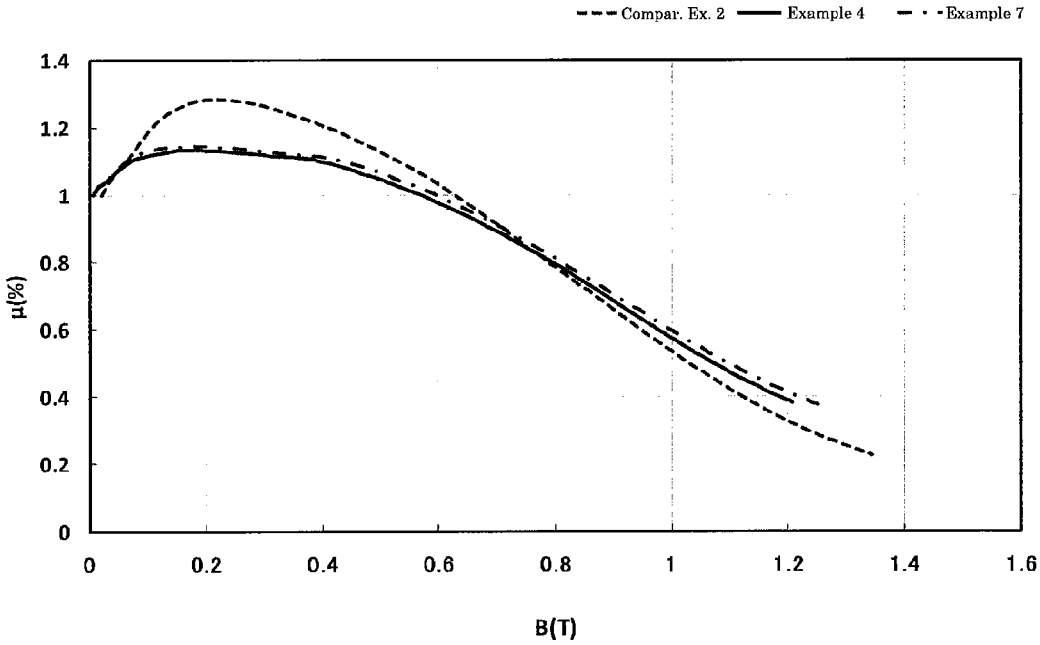
FIG. 5 is a diagram showing a relationship between a differential permeability and a magnetic flux density based on a DC B-H characteristic in the second characteristic comparison.

Table 2 shows a relationship among the soft magnetic powders, the kind and additive amount of the inorganic insulative powders, a first heating process temperature, a magnetic permeability and an iron loss (a core loss) per unit volume for the examples 4 to 14 and the comparative examples 2 to 6. FIG. 3 is a diagram showing a relationship between the additive amount of the fine powders and the DC superposition characteristic for the examples 4 to 14 and the comparative examples 2 to 6. Moreover, FIG. 4 is a diagram showing a DC B-H characteristic for each of the examples 4 and 7 and the comparative example 2, and FIG. 5 is a diagram showing a relationship between a differential magnetic permeability and a magnetic flux density based on the DC B-H characteristic in FIG. 4.

TABLE 2

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| A | — | — | — | — | — | 725 | Compar. Ex. 2 |
| B | Al2O3 | 100 | 13 | 0.25 | 1100 | 725 | Compar. Ex. 3 |
| | | | | 0.25 | 1100 | 725 | Compar. Ex. 4 |
| | | | | 0.40 | 1100 | 725 | Example 4 |
| | | | | 0.60 | 1100 | 725 | Example 5 |
| | | | | 0.70 | 1100 | 725 | Example 6 |
| | | | | 0.80 | 1100 | 725 | Example 7 |
| | | | | 1.00 | 1100 | 725 | Example 8 |
| | | | | 1.20 | 1100 | 725 | Example 9 |
| | | | | 1.50 | 1100 | 725 | Example 10 |
| C | Al2O3 | 25 | 60 | 0.25 | 1100 | 725 | Compar. Ex. 5 |
| | | | | 0.40 | 1100 | 725 | Example 11 |
| | | | | 0.70 | 1100 | 725 | Example 12 |
| | | | | 1.00 | 1100 | 725 | Example 13 |
| D | MgO | 160 | 230 | 0.20 | 1100 | 725 | Compar. Ex. 6 |
| | | | | 0.70 | 1100 | 725 | Example 14 |

TABLE 2-continued

| Item | Density g/cm3 | Density of magnetized portion % | Core loss (KW/m3) 100 mT@10 kHz Pc | Ph | Pe | DC B-H characteristics μi B = 0 T | B = 1 T | % | Magnetic permeability decrease | |
|---|---|---|---|---|---|---|---|---|---|---|
| A | 7.08 | 93.5 | 115 | 108 | 8 | 100 | 51 | 50.7 | 100.0 | Compar. Ex. 2 |
| B | 7.10 | 93.4 | 93 | 81 | 8 | 85 | 44 | 52.6 | 84.6 | Compar. Ex. 3 |
| | 7.06 | 92.9 | 101 | 90 | 9 | 73 | 36 | 49.8 | 72.6 | Compar. Ex. 4 |
| | 7.08 | 93.0 | 91 | 82 | 8 | 75 | 43 | 57.9 | 75.1 | Example 4 |
| | 7.06 | 92.6 | 89 | 80 | 8 | 67 | 43 | 63.9 | 67.3 | Example 5 |
| | 7.03 | 92.1 | 87 | 78 | 9 | 62 | 42 | 66.9 | 62.3 | Example 6 |
| | 7.00 | 91.6 | 86 | 74 | 9 | 60 | 41 | 69.1 | 60.1 | Example 7 |
| | 6.97 | 91.0 | 82 | 72 | 9 | 58 | 40 | 67.8 | 58.3 | Example 8 |
| | 6.95 | 90.6 | 79 | 70 | 8 | 57 | 38 | 66.9 | 57.5 | Example 9 |
| | 6.88 | 89.4 | 78 | 69 | 8 | 49 | 31 | 63.9 | 48.7 | Example 10 |
| C | 7.08 | 93.2 | 86 | 74 | 10 | 72 | 41 | 57.0 | 72.1 | Compar. Ex. 5 |
| | 7.09 | 93.2 | 74 | 65 | 10 | 66 | 42 | 62.6 | 66.4 | Example 11 |
| | 7.05 | 92.3 | 66 | 58 | 9 | 60 | 42 | 68.8 | 60.4 | Example 12 |
| | 7.02 | 91.7 | 66 | 56 | 10 | 57 | 39 | 68.1 | 57.3 | Example 13 |
| D | 7.08 | 93.3 | 103 | 93 | 12 | 80 | 45 | 57.2 | 79.5 | Compar. Ex. 6 |
| | 7.00 | 91.8 | 90 | 85 | 8 | 63 | 39 | 62.0 | 63.1 | Example 14 |

[DC B-H Characteristic]

The % of the DC B-H characteristic in table 2 is a ratio (μ(1 T)/μ(0 T)) of a magnetic permeability μ(0 T) when the magnetic flux density is 0 T and a magnetic permeability μ(1 T) when the magnetic flux density is 1 T. When this value is large, it means that the DC superposition characteristic is good. That is, as is clear from table 2, according to the soft magnetic powders containing 3.0 wt % of Si and produced through a gas atomizing technique, in the comparative examples 3 and 4 and the examples 4 to 10 in the field B, the comparative example 5 and the examples 11 to 13 in the field C, and the comparative example 6 and the example 14 in the field D, by adding the fine powders of equal to or greater than 0.4 wt %, the good DC B-H characteristic was obtained for all fields.

Conversely, regarding a density and a magnetic permeability in each field of table 2, when the field A having no fine powders added and the fields B to D having the fine powders added are compared, by adding the fine powders, the density decreased, and the magnetic permeability also decreased, which negatively affected the DC B-H characteristic. In particular, when the fine powders of greater than 1.5 wt % were added, the density greatly decreased and the DC B-H characteristic also decreased.

[Hysteresis Loss]

Regarding the hysteresis loss (Ph) in table 2, in the cases of the examples 4 to 14 and the comparative examples 3 to 6 having the inorganic insulative material added which was $Al_2O_3$, in comparison with the comparative example 1 having no inorganic insulative powders added, the hysteresis loss (Ph) at 10 kHz decreased. Hence, it becomes clear that the magnetic characteristic as a whole improved due to the decrease of the hysteresis loss.

In general, the higher the density is, the smaller the hysteresis loss becomes, but according to the examples, the density decreased but the hysteresis loss (Ph) also decreased. This is because if the fine powders are non-uniformly dispersed on the surface of the soft magnetic powder, the magnetic fluxes are concentrated at a portion where a gap between the magnetic powders is small, and the magnetic flux density near the contact increases, thereby increasing the hysteresis loss. According to the examples, by letting the fine powders uniformly dispersed, the gap between the magnetic powders is made uniform, and thus the hysteresis loss due to the concentration of the magnetic fluxes at the gap between the magnetic powders can be reduced. Accordingly, the hysteresis loss (Ph) can be reduced even if the density decreases. Moreover, the gap provided between the magnetic powders becomes a dispersed gap, thereby improving the DC superposition characteristic.

According to the above results, it is preferable that the additive amount of the inorganic insulative material to be added to the soft magnetic powders which are Fe—Si alloy powders containing 3.0 wt % of silicon components and which are used for the dust core of a reactor should be 0.4 to 1.5 wt % relative to the soft magnetic powders. If the additive amount is smaller than such values, a sufficient effect cannot be obtained, and if the additive amount exceeds 1.5 wt %, it results in a cause of the deterioration of the DC B-H characteristic due to the decrease of the density. Accordingly, even if the soft magnetic powders contain 3.0 wt % of silicon components, such powders are not sintered and solidified at the time of the heating process, and a reactor and a method for manufacturing the same can be provided which use a dust core that can effectively reduce the hysteresis loss.

[3-3. Third Characteristic Comparison (Comparison for Additive Amount of Inorganic Insulative Material)]

According to a third characteristic comparison, an additive amount of the inorganic insulative material to be added to the soft magnetic powders that were Fe—Si alloy powders containing 6.5 wt % of silicon components was subjected to a comparison. Table 3 shows the kind and constituent of the inorganic insulative material added to the soft magnetic powders as comparative examples 7 to 9 and examples 15 to 18. Regarding the average particle size of the inorganic insulative material, $Al_2O_3$ was 13 nm (specific surface: 100 $m^2/g$).

Regarding the samples used in this characteristic comparison, with respect to the Fe—Si alloy powders which were produced through a gas atomizing technique, had an average particle size of 22 μm, and contained 3.0 wt % of silicon components, the inorganic insulative powders were added as follows, and such powders were mixed for 30 minutes using a V type mixer to produce the samples.

In the comparative example 7 in a field E, no inorganic insulative powders were added.

In the comparative examples 8 and 9 in a field F, as the inorganic insulative powders, $Al_2O_3$ of 13 nm (specific surface: 100 $m^2/g$) was added by 0.15 to 0.25 wt %.

In the examples 15 to 18, as the inorganic insulative powders, $Al_2O_3$ of 13 nm (specific surface: 100 $m^2/g$) was added by 0.40 to 1.00 wt %.

Thereafter, a heating process of leaving those samples as those were under a reductive atmosphere of 25-% hydrogen (the remaining 75% was nitrogen) at a temperature of 1100° C. was performed for two hours. Next, a silane coupling agent of 0.25 wt % and a silicon resin of 1.2 wt % were successively mixed, the mixture was heated and let dried (180° C. and 2 hours), and zinc stearate of 0.4 wt % as a lubricating agent was added and mixed.

Those samples were pressed and shaped at a pressure of 1500 MPa and at a room temperature, and ring-shaped dust cores having an outer diameter of 16 mm, an inner diameter of 8 mm, and a height of 5 mm were produced. Those dust cores were subjected to an annealing process for 30 minutes at a temperature of 625° C. under a nitrogen atmosphere (90% of $N_2$ 10% of $H_2$).

Figure 6:
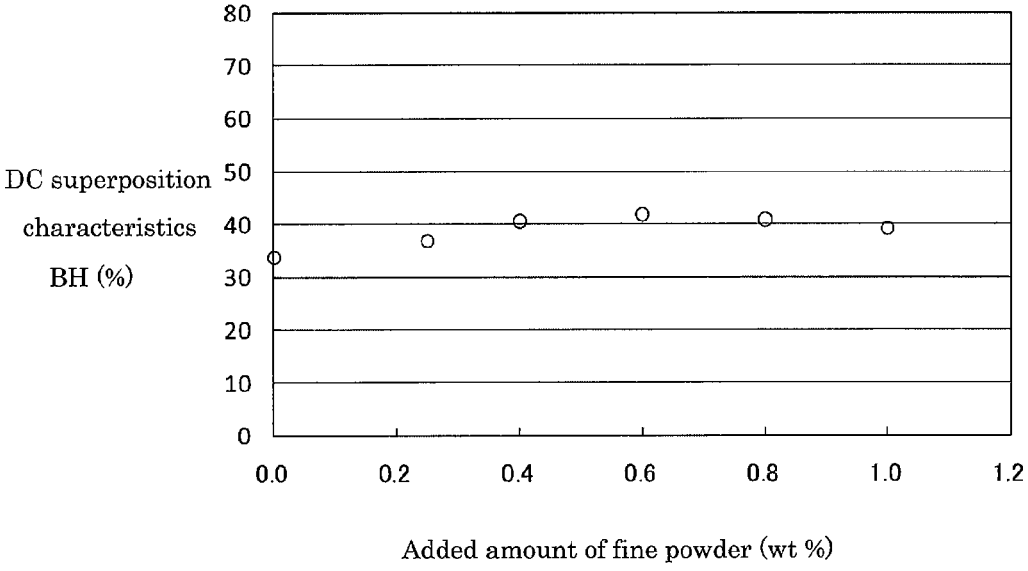
FIG. 6 is a diagram showing a relationship between an additive amount of fine powders and a DC superposition characteristic in a third characteristic comparison.

Table 3 shows a relationship among the soft magnetic powders, the kind and additive amount of the inorganic insulative powders, a first heating process temperature, a magnetic permeability and an iron loss (a core loss) per unit volume for the examples 15 to 18 and the comparative examples 7 to 9. FIG. 6 is a diagram showing a relationship between an additive amount of the fine powders and a DC superposition characteristic for the examples 15 to 18 and the comparative examples 8 and 9.

the soft magnetic powders containing 6.5 wt % of Si and produced through a gas atomizing technique, in the cases of the comparative examples 8 and 9 and the examples 15 to 18 in the field F, by adding the fine powders of equal to or greater than 0.4 wt %, the good DC B-H characteristic was obtained.

Conversely, regarding a density and a magnetic permeability in each field of table 3 and FIG. 6, when the field E having no fine powders added and the field F having the fine powders added were compared, by adding the fine powders, the density decreased, and the magnetic permeability also decreased, which negatively affected the DC B-H characteristic. In particular, when the fine powders of greater than 1.5 wt % were added, the density greatly decreased and the DC B-H characteristic also decreased.

[Hysteresis Loss]

Regarding the hysteresis loss (Ph) in table 3, in the cases of the examples 15 to 18 and the comparative examples 8 and 9 having the inorganic insulative material added which was $Al_2O_3$, in comparison with the comparative example 7 having no inorganic insulative powders added, the hysteresis loss (Ph) at 10 kHz decreased. Hence, it becomes clear that the magnetic characteristic as a whole improved due to the decrease of the hysteresis loss.

In general, the higher the density is, the smaller the hysteresis loss becomes, but according to the examples, the density decreased but the hysteresis loss (Ph) also decreased. This is because if the fine powders are non-uniformly dispersed on the surface of the soft magnetic powder, the magnetic fluxes are concentrated at a portion where a gap between the magnetic powders is small, and the magnetic flux density near the

TABLE 3

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| E | — | — | — | — | — | 725 | Compar. Ex. 7 |
| F | Al2O3 | 100 | 13 | 0.15 | 1100 | 725 | Compar. Ex. 8 |
| | | | | 0.25 | 1100 | 725 | Compar. Ex. 9 |
| | | | | 0.40 | 1100 | 725 | Example 15 |
| | | | | 0.60 | 1100 | 725 | Example 16 |
| | | | | 0.80 | 1100 | 725 | Example 17 |
| | | | | 1.00 | 1100 | 725 | Example 18 |

| | | | Core loss (KW/m3) 100 mT@10 kHz | | | DC B-H characteristics μi | | | Magnetic permeability | |
|---|---|---|---|---|---|---|---|---|---|---|
| Item | Density g/cm3 | Density of magnetized portion % | Pc | Ph | Pe | B = 0 T | B = 1 T | % | decrease | |
| E | 6.70 | 91.6 | 106 | 98 | 7 | 98 | 33 | 33.7 | 100.0 | Compar. Ex. 7 |
| F | 6.72 | 91.7 | 89 | 80 | 8 | 82 | 30 | 36.3 | 83.7 | Compar. Ex. 8 |
| | 6.73 | 91.6 | 83 | 75 | 8 | 76 | 28 | 36.9 | 77.7 | Compar. Ex. 9 |
| | 6.68 | 90.9 | 81 | 73 | 8 | 68 | 28 | 40.6 | 69.9 | Example 15 |
| | 6.65 | 90.3 | 80 | 71 | 8 | 63 | 27 | 41.9 | 64.9 | Example 16 |
| | 6.58 | 89.1 | 74 | 65 | 8 | 57 | 23 | 40.9 | 58.4 | Example 17 |
| | 6.53 | 88.3 | 73 | 64 | 8 | 54 | 21 | 39.2 | 55.6 | Example 18 |

[DC B-H Characteristic]

The % of the DC B-H characteristic in table 3 is a ratio (μ(1 T)/μ(0 T)) of a magnetic permeability μ(0 T) when the magnetic flux density is 0 T and a magnetic permeability μ(1 T) when the magnetic flux density is 1 T. When this value is large, it means that the DC superposition characteristic is good. That is, as is clear from table 3 and FIG. 6, according to contact increases, thereby increasing the hysteresis loss. According to the examples, by letting the fine powders uniformly dispersed, the gap between the magnetic powders is made uniform, and thus the hysteresis loss due to the concentration of the magnetic fluxes at the gap between the magnetic powders can be reduced. Accordingly, the hysteresis loss (Ph) can be reduced even if the density decreases. Moreover, the gap provided between the magnetic powders becomes a dispersed gap, thereby improving the DC superposition characteristic.

According to the above results, it is preferable that the additive amount of the inorganic insulative material to be added to the soft magnetic powders which are Fe—Si alloy powders containing 6.5 wt % of silicon components and which are used for the dust core of a reactor should be 0.4 to 1.5 wt % relative to the soft magnetic powders. If the additive amount is smaller than such values, a sufficient effect cannot be obtained, and if the additive amount exceeds 1.5 wt %, it results in a cause of the deterioration of the DC B-H characteristic due to the decrease of the density. Accordingly, even if the soft magnetic powders contain 6.5 wt % of silicon components, such powders are not sintered and solidified at the time of the heating process, and a reactor and a method for manufacturing the same can be provided which use a dust core that can effectively reduce the hysteresis loss.

[3-4. Fourth Characteristic Comparison (Comparison for Kind of Soft Magnetic Alloy Powders)]

In a fourth characteristic comparison, the kind of the soft magnetic powders to which the inorganic insulative powders were added was subjected to a comparison. The soft magnetic powders used in this characteristic comparison were pure iron produced through a water atomizing technique and having a particle size of equal to or smaller than 75 μm, pure iron produced through a water atomizing technique, having a particle size of equal to or smaller than 75 μm and having undergone a flattening process to have a degree of circularity which was 0.85, and Fe—Si alloy powders produced through a water atomizing technique, having a particle size of equal to or smaller than 63 μm and containing 1 wt % of silicon components.

The samples used in this characteristic comparison were produced as follows.

In an example 19 in a field G, with respect to pure iron produced through a water atomizing technique and having a particle size of equal to or smaller than 75 μm, as the inorganic insulative material, $Al_2O_3$ of 13 nm (specific surface: 100 $m^2/g$) was added and mixed for 30 minutes using a V type mixer.

In an example 20 in a field H, pure iron produced through a water atomizing technique and having a particle size of equal to or smaller than 75 μm was subjected to flattening to obtain pure iron having a degree of circularity which was 0.85, and with respect to such pure iron, as the inorganic insulative material, $Al_2O_3$ of 13 nm (specific surface: 100 $m^2/g$) was added and mixed for 30 minutes using a V type mixer.

In an example 21 in a field I, with respect to Fe—Si alloy powders produced through a water atomizing technique, having a particle size of equal to or smaller than 63 μm and containing 1 wt % of silicon components, as the inorganic insulative material, $Al_2O_3$ of 13 nm (specific surface: 100 $m^2/g$) was added and mixed for 30 minutes using a V type mixer.

Thereafter, a heating process of leaving those samples as those were under a reductive atmosphere of 25-% hydrogen (the remaining 75% was nitrogen) at a temperature of 1100° C. was performed for two hours. Next, a silane coupling agent of 0.25 wt % and a silicon resin of 1.2 wt % were successively mixed, the mixture was heated and let dried (180° C. and 2 hours), and zinc stearate of 0.4 wt % as a lubricating agent was added and mixed.

Those samples were pressed and shaped at a pressure of 1500 MPa and at a room temperature, and ring-shaped dust cores having an outer diameter of 16 mm, an inner diameter of 8 mm, and a height of 5 mm were produced. Those dust cores were subjected to an annealing process for 30 minutes at a temperature of 625° C. under a nitrogen atmosphere (90% of $N_2$ 10% of $H_2$).

Figure 7:
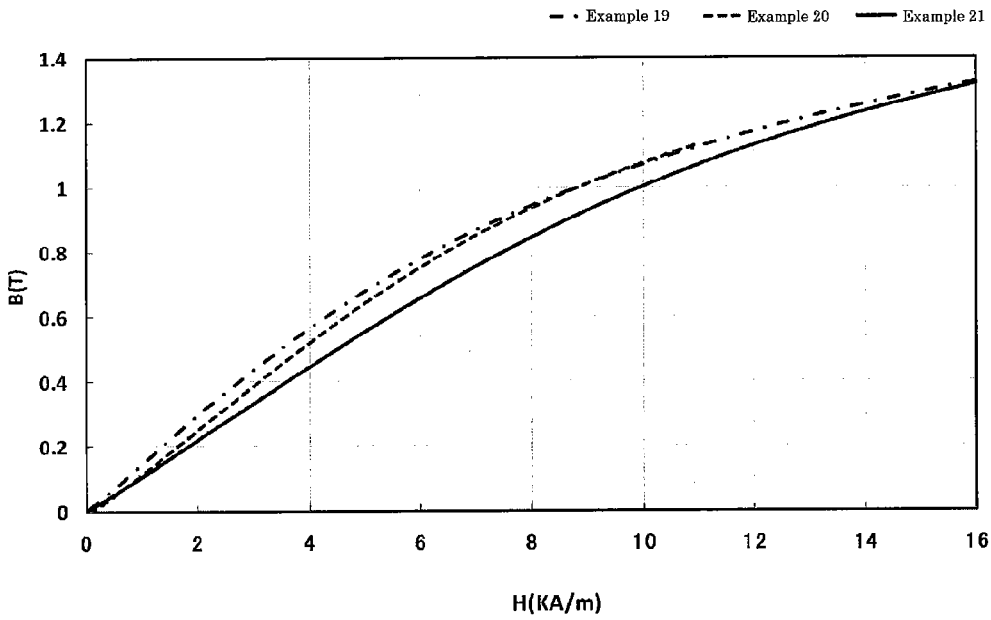
FIG. 7 is a diagram showing a DC B-H characteristic of a dust core in a fourth characteristic comparison.
Figure 8:
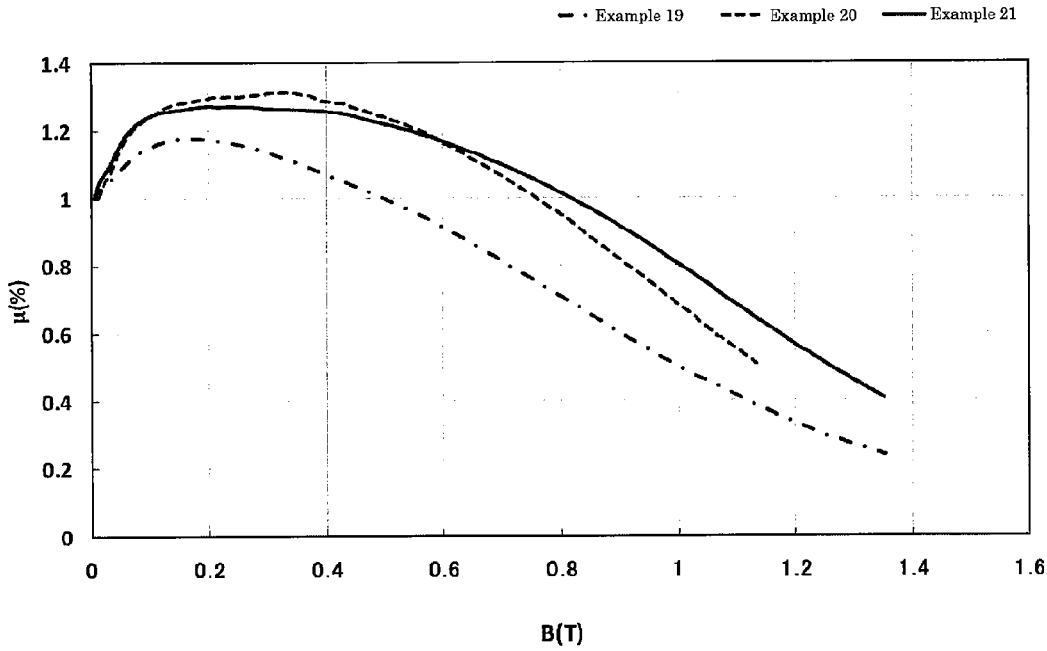
FIG. 8 is a diagram showing a relationship between a differential permeability and a magnetic flux density based on a DC B-H characteristic in the fourth characteristic comparison.

Table 4 shows a relationship among the soft magnetic powders, the kind and additive amount of the inorganic insulative powders, a first heating process temperature, a magnetic permeability and an iron loss (a core loss) per unit volume for the examples 19 to 21. FIG. 7 is a diagram showing respective DC B-H characteristics of the examples 19 to 21, and FIG. 8 shows a relationship between a differential magnetic permeability and a magnetic flux density based on the DC B-H characteristic shown in FIG. 7.

TABLE 4

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| G | Al2O3 | 100 | 13 | 0.75 | 1100 | 650 | Example 19 |
| H | | | | 0.50 | 1100 | 650 | Example 20 |
| I | | | | 0.50 | 1100 | 650 | Example 21 |

| | | | Core loss (KW/m3) 100 mT@10 kHz | | | DC B-H characteristics μi | | | | |
|---|---|---|---|---|---|---|---|---|---|---|
| Item | Density g/cm3 | Density of magnetized portion % | Pc | Ph | Pe | B = 0 T | B = 1 T | % | Magnetic permeability decrease | |
| G | 7.21 | 90.9 | 96 | 72 | 20 | 103 | 53 | 51.1 | 73.5 | Example 19 |
| H | 7.20 | 91.0 | 98 | 80 | 18 | 84 | 57 | 68.1 | 60.2 | Example 20 |
| I | 7.12 | 90.0 | 98 | 78 | 16 | 71 | 58 | 80.6 | 71.4 | Example 21 |

[DC B-H Characteristic]

The % of the DC B-H characteristic in table 4 is a ratio (μ(1 T)/μ(0 T)) of a magnetic permeability μ(0 T) when the magnetic flux density is 0 T and a magnetic permeability μ(1 T) when the magnetic flux density is 1 T. When this value is large, it means that the DC superposition characteristic is good. That is, as is clear from table 4, in the examples 19 and 20 containing 0 wt % of Si components and the example 21 containing 1.0 wt % of Si components, like the soft magnetic powders containing 3.0 to 6.5 wt % of Si and produced through a gas atomizing technique, by adding the inorganic insulative powders, the good DC B-H characteristic was obtained. Moreover, when the examples 20 and 21 in FIG. 8 were compared, the one having undergone the flattening process had a good DC superposition characteristic.

Furthermore, it becomes clear from FIGS. 7 and 8 that the example 20 having undergone the flattening process had a better magnetic permeability in an applied magnetic field in comparison with the example 19 having the soft magnetic powders not subjected to the flattening process. This is because the concavities and convexities of the surface can be eliminated and the shape of the powder becomes close to a true sphere by performing the flattening process on the soft magnetic powders. Hence, it becomes possible to produce a dust core with a high density even if the pressure is low. The dust core has a characteristic that the higher the density is, the better the DC superposition characteristic becomes, and it is apparent that the DC superposition characteristic is improved due to the increase of the density of the dust core.

According to the above-explained results, when soft magnetic powders that are Fe—Si alloy powders containing 0 to 6.5 wt % of silicon components are used as the soft magnetic alloy powders for the dust core of a reactor, it becomes possible to provide the dust core that is not only low-loss but also high-density and thus having a good DC superposition characteristic. Moreover, by performing the flattening process together, it becomes possible to provide a reactor and a method for manufacturing the same which use the dust core that has further higher density and better DC superposition characteristic.

[3-1. Third Characteristic Comparison (Comparison for Additive Amount of Inorganic Insulative Material for Reactor Magnetic Core)]

According to the third characteristic comparison, a reactor magnetic core having the additive amount of the inorganic insulative material to be added to the soft magnetic powders changed was subjected to a comparison. Table 5 shows an additive amount of the inorganic insulative material added to the soft magnetic powders as comparative examples 10 to 12 and the examples 22 to 24. Regarding an average particle size of the inorganic insulative material, $Al_2O_3$ was 13 nm (specific surface: 100 $m^2/g$).

The samples used in this characteristic comparison were produced by, with respect to Fe—Si alloy powders produced through a gas atomizing technique, having an average particle size of 22 μm and containing 3.0 wt % of silicon components, adding the inorganic insulative powders as follows.

In the comparative examples 10 to 12 and the examples 22 to 24 in fields J to M, as the inorganic insulative powders, 13 nm (specific surface: 100 $m^2/g$) of $Al_2O_3$ was added by 0.25 to 1.00 wt %.

Thereafter, a heating process of leaving those samples as those were under a reductive atmosphere of 25-% hydrogen (the remaining 75% was nitrogen) at a temperature of 1100° C. was performed for two hours. Next, a silane coupling agent of 0.25 wt % and a silicon resin of 1.2 wt % were successively mixed, the mixture was heated and let dried (180° C. and 2 hours), and zinc stearate of 0.4 wt % as a lubricating agent was added and mixed.

The samples of the fields J, K, and M were pressed and shaped at a pressure of 1500 MPa and at a room temperature. The sample of the field L was pressed and shaped at a pressure of 1200 MPa and at a room temperature. Thereafter, ring-shaped dust cores having an outer diameter of 60 mm, an inner diameter of 30 mm, and a height of 25 mm were produced. Those dust cores were subjected to an annealing process for 30 minutes at a temperature of 625° C. under a nitrogen atmosphere ($N_2$+$H_2$). A copper winding having a diameter of 2.2 mm was rolled around those samples by 60 turns (windings) to form reactors, and a DC superposition characteristic was measured through an LCR meter.

Table 5 shows a relationship among the additive amount of the inorganic insulative powders, a density, and the density and magnetic permeability of a magnetic portion for the examples 22 to 24 and the comparative examples 10 to 12.

TABLE 5

| Item | Additive Amount WT % | Density g/cm3 | Density of Magnetic Portion % | Magnetic permeability decrease | |
|---|---|---|---|---|---|
| J | 0.25 | 7.10 | 93.4 | 73 | Compar. Ex. 10 |
| K | 0.25 | 7.10 | 93.4 | 52 | Compar. Ex. 11 |
| L | 0.25 | 6.98 | 91.9 | 54 | Compar. Ex. 12 |
| M | 0.40 | 7.08 | 93.0 | 68 | Example 22 |
| | 0.70 | 7.03 | 92.1 | 54 | Example 23 |
| | 1.00 | 6.97 | 91.0 | 51 | Example 24 |

Figure 9:
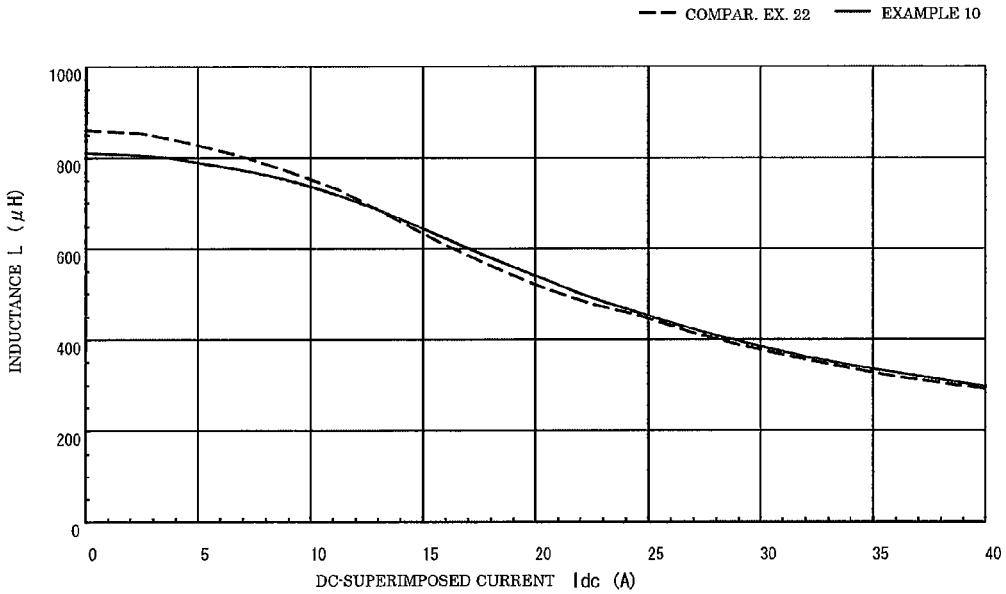
FIG. 9 is a diagram showing a relationship between a DC superimposed current and an inductance in the fourth characteristic comparison.

As is clear from table 5, the density, and the density and magnetic permeability of the magnetic portion decrease together with the increase of the additive amount of the inorganic insulative powders. Moreover, FIG. 9 is a diagram showing a relationship between a DC-superimposed current and an inductance for the example 22 and the comparative example 10. When the comparative example 10 of FIG. 9 is compared with the example 22, with a current of equal to or smaller than 12 A, the comparative example 10 had a larger inductance, but when the current exceeded 12 A, the comparative example 10 had the inductance decreased. That is, the comparative example 10 had the larger decreasing rate of the inductance, and was a reactor largely affected by the inductance.

Figure 10:
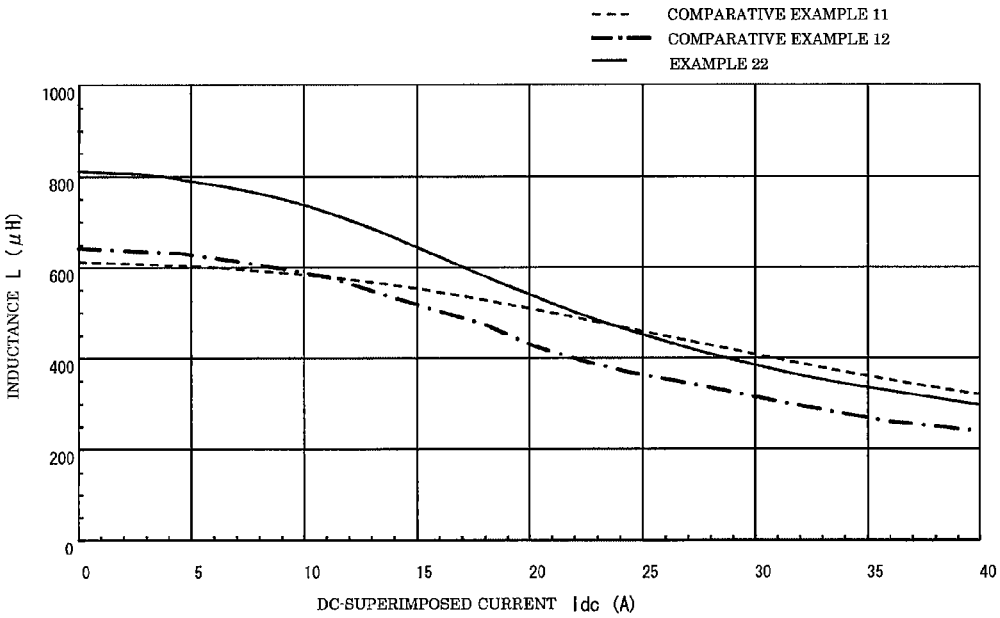
FIG. 10 is a diagram showing a relationship between a DC superimposed current and an inductance in the fourth characteristic comparison.

FIG. 10 shows a relationship between a DC-superimposed current and an inductance for each example and comparative example regarding the example 22 and the comparative examples 11 and 12. It becomes clear from FIG. 10 that when the example 22 and the comparative example 12 are compared, the comparative example 12 having the reactor provided with a gap had a lower decreasing rate of the inductance with a current of equal to or higher than 25 A. That is, even if the additive amount of the inorganic insulative powders is little, the good superimpose characteristic can be obtained by providing a gap in a reactor.

Figure 11:
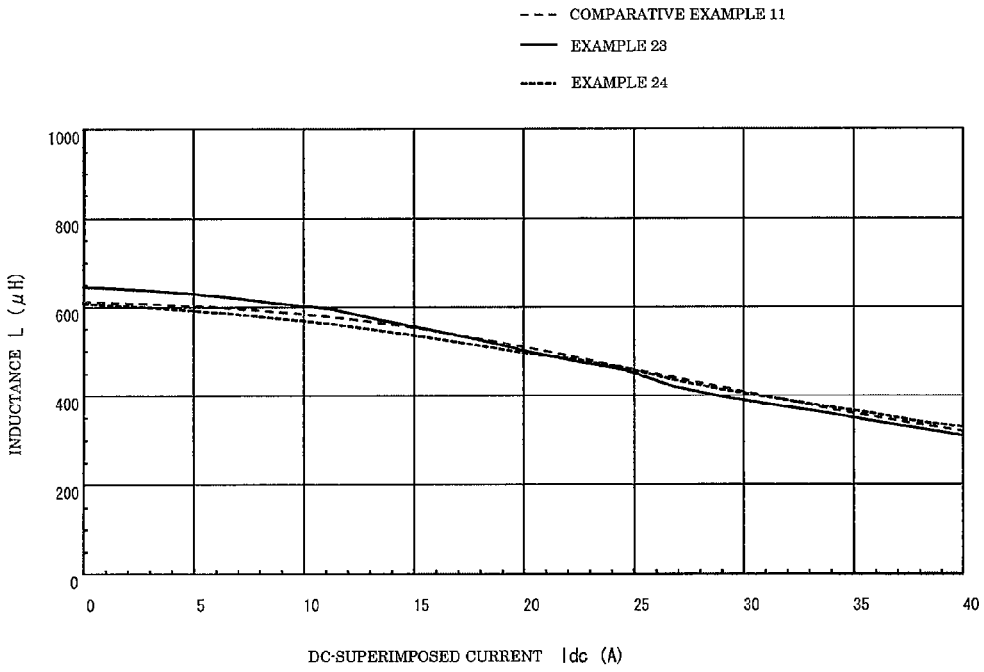
FIG. 11 is a diagram showing a relationship between a DC superimposed current and an inductance in the fourth characteristic comparison.

FIG. 11 shows a relationship between a DC-superimposed current and an inductance for each example and comparative example regarding the examples 23, 24 and the comparative example 11. It becomes clear from FIG. 11 that when the examples 23, 24 are compared with the comparative example 12, the examples 23, 24 having the reactors provided with no gap have a similar DC superposition characteristic to that of the comparative example 12 having the reactor provided with a gap.

Figure 12:
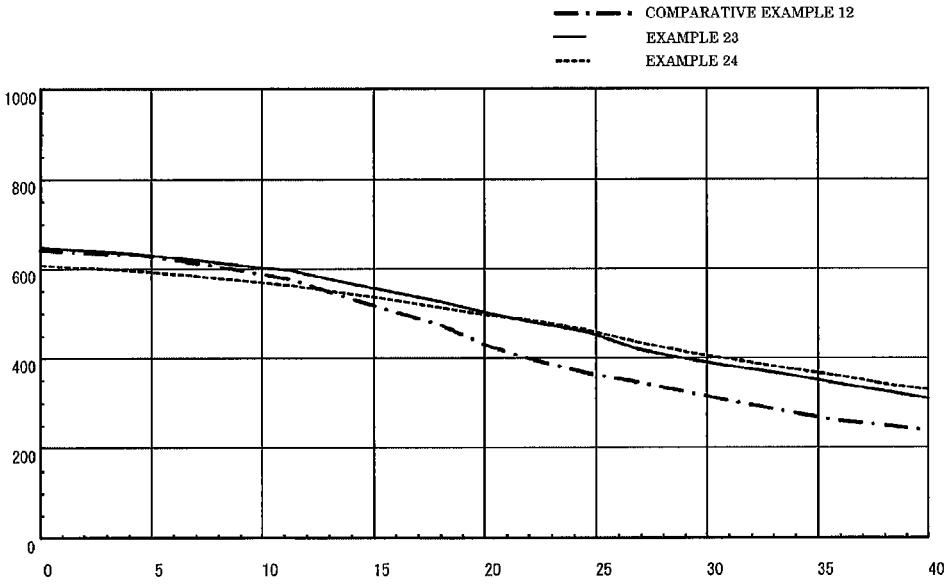
FIG. 12 is a diagram showing a relationship between a DC-superimposed current and an inductance in the fourth characteristic comparison.
Figure 13:
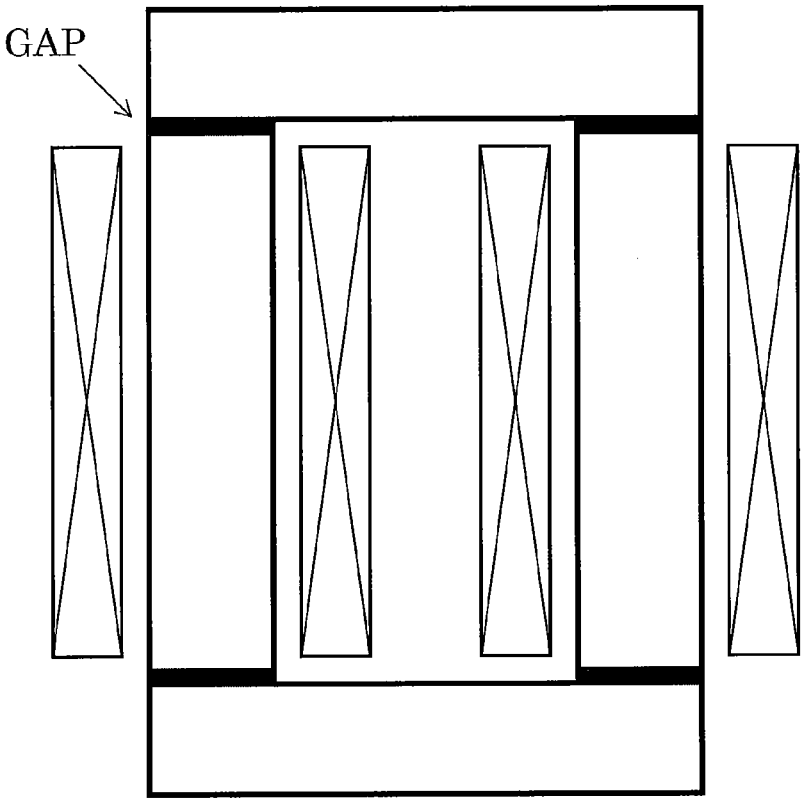
FIG. 13 is a cross-sectional view showing a conventional reactor having a core with gaps.

FIG. 12 shows a relationship between a DC-superimposed current and an inductance for each example and comparative example regarding the examples 23, 24 and the comparative example 12. The comparative example 12 had an L value matched with those of the examples 23, 24 by decreasing the density upon reduction of the pressure at the time of molding, but it becomes clear that the L value greatly decreases with a current of equal to or greater than 10 A. That is, like the examples 23, 24, it becomes clear that by adding the insulative powders and performing the molding at a predetermined pressure, the DC superposition characteristic can be improved.

As is clear from the above-explained results, when soft magnetic powders used for the dust core of a reactor and 0.4 wt % to 1.5 wt % of inorganic insulative powders are mixed, and a heating process is performed at a first heating temperature of equal to or higher than 1000° C. but below a temperature that causes the soft magnetic powders to start sintering to produce a dust core and under a non-oxidizing atmosphere, it becomes possible to provide a reactor and a method for manufacturing the same that have a reactor magnetic core which is the foregoing magnetic core, and which does not largely decrease an L value (an inductance) in a high magnetic field to maintain a good DC superposition characteristic.

The invention claimed is:

1. A reactor comprising:

a dust core; and a winding wound around the dust core, the dust core being formed by:

mixing soft magnetic powders with inorganic insulative powders of 0.4 wt % to 1.5 wt % relative to the soft magnetic powders;

mixing and granulating a mixture of the soft magnetic powders and the inorganic insulative powders with a binder insulative resin, and further mixing a lubricating resin therewith; and pressing and molding a mixture to form a mold, and annealing the mold, the dust core that is a core of the reactor being provided with no gap orthogonal to a magnetic path of the dust core.

2. The reactor according to claim 1, wherein the soft magnetic powders and the inorganic insulative powders are mixed and a heating process is performed on a mixture at a temperature of equal to or higher than 1000° C. and below a temperature that causes the soft magnetic powders to start sintering and under a non-oxidizing atmosphere to form the dust core, and the winding is wound around the dust core.

3. The reactor according to claim 2, wherein an average particle size of the inorganic insulative powders is 7 to 500 nm.

4. The reactor according to claim 3, wherein the soft magnetic powders contain silicon components of 0 to 6.5 wt %.

5. The reactor according to claim 2, wherein the soft magnetic powders contain silicon components of 0 to 6.5 wt %.

6. The reactor according to claim 5 wherein the soft magnetic powders include a silicon component of no greater than 6.5 wt %.

7. The reactor according to claim 1, wherein an average particle size of the inorganic insulative powders is 7 to 500 nm.

8. The reactor according to claim 7, wherein the soft magnetic powders contain silicon components of 0 to 6.5 wt %.

9. The reactor according to claim 1, wherein the soft magnetic powders contain silicon components of 0 to 6.5 wt %.

10. In a reactor, the improvement comprising:

a dust core of a configuration to support an electrical winding about the dust core with no gap openings orthogonal to a magnetic path in a body of the dust core;

the dust core includes a plurality of soft magnetic powders separated by inorganic insulative powders in a binder of an insulative resin, the soft magnetic powders are non-sintered and relieved of any strain while a silane coupling agent is used to enhance an adhesive bonding of the inorganic insulative powders and the soft magnetic powders, wherein the inorganic insulative powders are within a range of 0.4 wt % to 1.5 wt % relative to the soft magnetic powders.

11. The reactor of claim 10 wherein the inorganic insulative powders are selected from one of MgO, $Al_2O_3$, $TiO_2$ and CaO.

12. The reactor of claim 10 wherein an average particle size of the inorganic insulative powders is within a range of 7 nm to 500 nm.

* * * * *